US006138482A

United States Patent [19]

Shima et al.

[11] Patent Number: 6,138,482

[45] Date of Patent: Oct. 31, 2000

[54] METHOD OF KNITTING A KNITWEAR FORMING THEREIN A CONNECTING PART

[75] Inventors: Masahiro Shima; Keizo Akamatsu; Yoshinori Shimasaki, all of Wakayama, Japan

[73] Assignee: Shima Seiki Manufacturing Limited, Wakayama, Japan

[21] Appl. No.: 09/447,242

[22] Filed: Nov. 23, 1999

[30] Foreign Application Priority Data

Nov. 26, 1998 [JP] Japan ..... 10-336223

[51] Int. Cl.[7] ..... D04B 7/30

[52] U.S. Cl. ..... 66/69; 66/75.1; 66/172 R; 66/176

[58] Field of Search ..... 66/60 R, 64, 69, 66/169 R, 170, 172 R, 171, 75.1

[56] References Cited

U.S. PATENT DOCUMENTS

| | | | |
|---|---|---|---|
| 3,668,898 | 6/1972 | Betts et al. | 66/172 R |
| 5,203,185 | 4/1993 | Okuno | 66/172 R |
| 5,257,514 | 11/1993 | Okuno | 66/172 R |
| 5,284,031 | 2/1994 | Stoll et al. | 66/172 R |
| 5,377,507 | 1/1995 | Shima | 66/172 R |
| 5,987,930 | 11/1999 | Nakai | 66/172 R |

*Primary Examiner*—Danny Worrell
*Attorney, Agent, or Firm*—Arent Fox Kintner Plotkin & Kahn PLLC

[57] ABSTRACT

A knitting method that can permit the forming of a connecting part of the knitting fabric overlapped in front and back, such as a pleat or fly, even when the knitting fabric is knitted in a double jersey stitch structure. The method comprises the steps that the first and second knitting fabrics are knitted in double jersey stitch structure; that stitch loops of one of the first and second knitting fabrics which are to be overlapped with related stitch loops of the other of the first and second knitting fabrics are transferred to the opposed needle beds, whereby the first and second knitting fabrics are divided between the first needle bed and the second needle bed; that stitch loops of one of the first and second knitting fabrics which are not to be overlapped with related stitch loops of the other of the first and second knitting fabrics are held on the needles of the opposed needle beds, whereby the stitch loops of the first knitting fabric are retained by the needles of the first needle bed and the stitch loops of the second knitting fabric are retained by the needles of the second needle bed; that the first needle bed and/or the second needle beds are racked in a direction of the first knitting fabric and the second knitting fabric being moved closer to each other, so that the first and second knitting fabrics can be overlapped with each other in front and back; that the stitch loops held on the needles of each of the opposed needle beds are transferred back to their original needle beds; and that stitch loops of the next course are formed in double jersey stitch structure in the needles belonging in the region in which the first and second knitting fabrics are retained with overlapped in front and back.

3 Claims, 12 Drawing Sheets

METHOD OF KNITTING A KNITWEAR FORMING THEREIN A CONNECTING PART

BACKGROUND OF THE INVENTION

1. Technical Field of the Invention

The present invention relates to a knitting method for forming a connecting part of a knitting fabric in an overlapped state, such as a fly of a polo shirt or pleats of a skirt, by the use of a flat knitting machine having at least a pair of front and back needle beds, either or both of which are arranged movable leftward and rightward and each of which mounts thereon compound needles each comprising a needle proper having a hook at a top end thereof and a slider having a tongue composed of two thin plates, the needle proper and the slider being each arranged individually movable forward and backward so that a stitch loop can be retained in the hook of the needle proper as well as on the tongue of the slider.

2. Description of the Prior Art

In the earlier application (Japanese Patent Application No. Hei 10(1998)-111842 (which corresponds to EP 0 881 314)(Title: "A method for holding a stitch loop"), the applicant previously disclosed the knitting in which a stitch loop is held in the hook of the needle proper as well as on the tongue of the slider (hereinafter it is sometimes referred to as "the stitch-loop-holding knitting"). One example of a compound needle of the flat knitting machine for use in the stitch-loop-holding knitting is illustrated in FIG. 10, and the principle of the stitch-loop-holding knitting is illustrated in FIGS. 11 and 12. As shown in FIG. 10, a needle proper 51 of the compound needle has a hook 53 at a top end thereof and has at the rear side of the hook 53 a slider-receiving groove 57 receiving therein a slider 55 and supporting the slider 55 in such a manner as to be movable back and forth in the sliding direction of the needle proper. The slider 55 comprises two combined thin plates 55*a*, 55*b* of substantially the same configuration and is accommodated in the slider-receiving groove 57 formed in the needle proper. The slider 55 is provided, at an end portion thereof, with a tongue 59 capable to advance to a position beyond the hook 53 of the needle proper. The needle proper 52 and the slider 55 are provided with control butts 61, 63 in protruding relation from the needle groove, respectively. The control butts 61, 63 are controllably moved forward and backward via control cams (not shown) provided on a carriage that travel over the needle beds, to operate the compound needles 51 to effect a desired knitting.

FIG. 10B shows a state in which the slider 55 is further advanced beyond the hook 53 of the needle proper 52. FIG. 10C is an enlarged view of a top end part of the advanced slider, and FIG. 10D is a plan view thereof. When the tongue 59 of the slider 55 is advanced beyond the hook 53, the end of the two-ply tongue is separated and expanded into 59*a*, 59*b* by the end of the hook 53. Then, the tongue in this state is further advanced, so that a stitch loop 71 on the tongue 59 is pushed up to a position over a trick gap to be guided to a transferring position or a holding position. In transferring the stitch loop, the hook of the needle proper of the compound needle on an opposed needle bed (not shown) which is on the loop receiving side is inserted into the stitch loop 71 retained on the tongues 59*a*, 59*b* of the expanded slider 55 to receive the stitch loop 71 in the hook. In holding the stitch loop, the compound needle on the opposed needle bed is moved forward, with the hook closed by the end of the hook and the tongue of the slider being abutted with each other, so that the stitch loop 71 retained on the tongues 59*a*, 59*b* is received on the tongue of the slider.

In the following, the steps for the stitch loop to be held onto the needle on the opposed back needle bed from the front needle bed will be described with reference to FIGS. 11 and 12. In the step A, which shows a state of the needle beds immediately before the holding of the stitch loop, the opposed compound needles 51*f*, 51*b* on the front and back needle beds FB, BB retain stitch loops 75*f*, 75*b* in the hooks, respectively.

In the step B, the needle proper 52*f* of the compound needle on the front needle bed FB is moved forward to guide the stitch loop 75*f* retained in the hook 53*f* to a position on the tongue 59*f* of the slider. In the subsequent step C, the slider 55*f* is moved forward and also the needle proper 52*f* is moved backward, so that the stitch loop 75*f* is pushed up to the position over the trick gap, with its retained on the tongue 59*f* of the slider, to guide the stitch loop to the holding position.

In the step D, the needle 51*b* on the receiving side is moved forward, with the hook closed by the end of the hook 53*b* and the end of the tongue 59*b* of the slider abutted with each other, so that it is made to go into the tongue 59*f* of the slider separated and expanded by the hook of the needle on the receiving side so as to penetrate into the stitch loop 75*f* retained on the tongue.

In the subsequent step E, the slider 55*f* of the needle 52*f* on the front needle bed as moved forward to the holding position is moved backward, so that the loop 75*f* is moved from the slider of the needle of the front needle bed FB and held on the tongue 59*b* of the slider of the needle 51*b* of the back needle bed BB.

Then, in the step F shown in FIG. 12, the needle proper 52*b* and the slider 55*b* of the needle 51*b* on the back needle bed BB receiving the loop 75*f* are moved backward to a position as illustrated. The slider 55*b* in this position prevents the held stitch loop 75*f* from falling off from the end of the tongue 59*b*. As a result, the needle 51*b* of the back needle bed BB comes to retain in the hook 53*b* the stitch loop 75*b* as was therein and also retain on the tongue 59*b* of the slider the stitch loop 75*f* which has just received thereon.

While the stitch loop 75*f* is in its held state, the needle 51*f* of the front needle bed FB freed from the retaining of the stitch loop can be engaged in the subsequent knitting of the knitting fabric to permit a new knitting of the knitting fabric, for example.

Next, the return of the as-held stitch loop will be described below. The return is performed in the following steps which are similar to the steps for the ordinal transference of the stitch loop. First, in the step G, the slider 55*b* of the needle 51*b* on the back needle bed BB is moved forward up to a loop-receiving position, so that the stitch loop 75*f* is pushed up to the position over the trick gap. Then, in the step H, the needle 51*f* on the front needle bed FB is made to go into the tongue 59*b* of the slider, with the hook open, to penetrate into the stitch loop 75*f* retained on the tongue. After that, in the steps I and J, the needle 51*b* on the back needle bed BB holding thereon the stitch loop 75*f* is moved backward to transfer the stitch loop 75*f* back to the needle 51*f* on the front needle bad FB and also move the each needle backward. As a result of this, the needles 51*f* on the front needle bed FF and the needle 51*b* on the back needle bed BB are return to their original state of each retaining therein the stitch loop 75*f*, 75*b*.

The stitch loops may be held on the needles on one needle bed from the needles on the other needle bed directly, as mentioned above, or may alternatively be held on by way of transfer jacks in a flat knitting machine having a transfer jack bed, as disclosed by Japanese Patent Application No. Hei 10(1998)-111842 (EP 0 881 314).

Thus, the term of "the holding" of the stitch loop and a similar terminology used in the description is not merely intended to mean a common "transference" of the stitch loop into a hook of the other needle. In the common transference of the stitch loop, if the needle on the receiving side already retains a stitch loop therein, then double stitch loops will be formed in the hook of the needle without being separated. In contrast to this, in the holding of the stitch loop, the needle on the receiving side separates the received stitch loop from the stitch loop held in the needle itself so that the stitch loop held in the needle itself and the received stitch loop can be held in the hook of the needle proper and on the tongue of the slider, respectively.

Studies have been made hitherto on a knitting method, which is called "an integral knit", for knitting a knitting fabric with a collar, a pocket and the like on the flat knitting machine, with the aim of eliminating or lessening the need of a post handling after completion of the knitting when a knitting fabric is knitted by use of the flat knitting machine. In Japanese Patent Publication No. Hei 7(1995)-111021 (which corresponds to EP 0 455 395 and U.S. Pat. No. 5,253,492), the applicant discloses the method of forming pleats in a waist region of a knitwear, such as one-piece garment or a skirt, on the flat knitting machine as a method of the integral knit. This publication discloses a method of knitting pleats in knitwear comprising the steps of: knitting a succession of surface knitted sections, fold-back knitted section and overlap knitted sections; removing the fold-back knitted sections from the corresponding needles after fastening of thread ends; transferring the surface knitted section and/or the overlap knitted section to vacant needles from which the fold-back knitted sections were previously removed, so that the ends of the surface knitted sections and the overlap knitted sections are located adjacent to each other; loading a succession of the surface, overlap, and surface knitted sections onto the array of needles on one of the needle beds; after racking the other needle bed in a direction opposite to the fold-back direction of the fold-back section so that one of the overlap knitted sections and the surface knitted sections form overlapping regions, loading the overlap or surface knitted section onto the knitting needles of the other needle bed; after racking the other needle bed in a direction of the surface knitted sections and the overlap knitted sections being overlapped with each other, overlapping the overlap section with the surface section through stitch transferring; and binding the overlapped regions in pleats.

According to the knitting method disclosed by JP Patent Publication No. Hei 7(1995)-111021 above, needles on one of the front and back needle beds are used for the knitting of a knitwear and, accordingly, vacant needles on the opposed needle bed can be used for transferring the stitch loops transversely, and as such can allow the knitting fabrics knitted in the adjoining regions to be overlapped with each other in front and back. However, when all the front and back needles are required to be used for knitting a knitwear in the knit structure including a double jersey stitch structure, such as a Milano-rib structure, a full-rib-knit structure, a 2×1 rib structure, or a tubular structure, there exist no empty needles available for the transference of stitch loops, for the reason of which the pleats can no longer be formed by the method disclosed by JP Patent Publication No. Hei 7(1995)-111021. Thus, according to the known knitting method, since the transference of stitch loops in the transverse direction cannot be permitted for a knitwear knitted in the knit structure including the double jersey stitch structure, when the knit structure including the double jersey stitch structure is formed, neither the pleats mentioned above nor a fly of a polo shirt formed by two separately knitted fabrics being partly overlapped with each other.

SUMMARY OF THE INVENTION

In consideration of the drawbacks mentioned above, the present invention has been made. It is an object of the present invention to disclose a knitting method that can permit the pleats or fly mentioned above to be formed through the use of the stitch-loop-holding knitting even when the knitting fabric including the double jersey stitch structure, such as a Milano rib structure and a full-rib-knit structure, which is formed in the state in which the stitch loops are retained by the needles on both the front needle bed and the back needle bed is knitted.

The present invention provides a novel method of knitting a knitwear forming therein a connecting part of partly overlapped first and second knitting fabrics by use of a flat knitting machine which comprises arrays of compound needles, each having a needle proper with a hook at a top end thereof and a slider having a tongue comprising two thin plates and being so structured that the needle proper and the slider can be individually moved forward and backward, and first and second needle beds mounting thereon the arrays of compound needles and oppositely arranged in front and back and is structured so that a stitch loop can be transferred between the first and second needle beds and also the tongue of the slider of the needle retaining the stitch loop in the hook of the needle proper can be advanced into the stitch loop retained on the tongue of the slider on the opposed needle bed, to permit the stitch-loop-holding knitting that the stitch loops are held in the hook of the knitting needle as well as on the tongue of the same knitting needle, wherein the connecting part of the partly overlapped first and second knitting fabrics is formed with the use of needles belonging in different regions on both the front needle bed and the back needle bed, the method comprising the steps:

(a) that the first knitting fabric formed by use of the needles belonging in a first region of each of the first and second needle beds and the second knitting fabric formed by use of the needles belonging in a second region of each of the first and second needle beds are knitted in double jersey stitch structure;

(b) that stitch loops of the first knitting fabric to be overlapped with related stitch loops of the second knitting fabric, of the stitch loops of the first knitting fabric retained in the needles on the second needle bed, and stitch loops of the second knitting fabric to be overlapped with the related stitch loops of the first knitting fabric, of the stitch loops of the second knitting fabric retained in the needles on the first needle bed, are transferred to the first needle bed and the second needle bed, respectively, to be overlapped with the related stitch loops, whereby the first knitting fabric and the second knitting fabric are divided between the first needle bed and the second needle bed;

(c) that stitch loops of the first knitting fabric not to be overlapped with related stitch loops of the second knitting fabric, of the stitch loops of the first knitting fabric retained in the needles on the second needle bed, and stitch loops of the second knitting fabric not to be overlapped with the related stitch loops of the first knitting fabric, of the stitch loops of the second knitting fabric retained in the needles on the first needle bed are held on the needles of the first needle bed and on the needles of the second needle bed, respectively, whereby the stitch loops of the first knitting fabric are retained by the needles of the first needle bed and the stitch loops of the second knitting fabric are retained by the needles of the second needle bed;

(d) that the first needle bed and/or the second needle beds are racked in a direction of the first knitting fabric and the second knitting fabric being moved closer to each other, so that the first and second knitting fabrics are partly or fully overlapped with each other in front and back;

(e) that the stitch loops held on the needles on each of the opposed needle beds are transferred back to their original needle beds; and (f) that stitch loops of the next course are formed in double jersey stitch structure in the needles belonging in the region in which the first and second knitting fabrics are retained with overlapped in front and back.

According to the construction above, of stitch loops of the first and second knitting fabrics formed in different regions, the stitch loops of the first knitting fabric at the connecting part and the stitch loops of the second knitting fabric at the connecting part are transferred to the first needle bed and the second needle bed, respectively, and stitch loops of the first knitting fabric at other parts than the connecting part are held on the needles on the first needle bed and stitch loops of the second knitting fabric at other parts than the connecting part are held on the needles on the second needle bed, whereby the stitch loops of the first knitting fabric are retained by the needles of the first needle bed and the stitch loops of the second knitting fabric are retained by the needles of the second needle bed. Then, the first needle bed and/or the second needle beds are racked, so that the stitch loops of the first and second knitting fabrics at the connecting parts can be overlapped with each other in front and back and thereafter stitch loops of the next course are formed in double jersey stitch structure at the stitch loops of the connecting parts, whereby the first knitting fabric and the second knitting fabric are connected together. According to this knitting method, for example, when a fly of a polo shirt is knitted from the collar side toward the rib hem side, the fly is knitted, while being formed in the right front body part knitted as the first knitting fabric and the left front body part knitted as the second knitting fabric part which are knitted with the use of the needles belonging in the different regions. In the connecting part in which the right front body part and the left front body part are connected together, the stitch loops of the fly of the right front body part and the stitch loops of the fly of the left front body part are overlapped with each other to form new stitch loops of the next course, so as to connect the right front body and the left front body. Thus, the knitting fabric forming therein the fly can be knitted in knit structure including the double jersey stitch structure.

The first knitting fabric and the second knitting fabric may be separate knitting fabrics which are knitted by use of different yarn feeders.

In the method above, the first and second knitting fabrics may be formed of first and second knitting regions in the same knitting fabric knitted by use of the needles belonging in different regions and the same yarn feeder; a fold-back knitting fabric part is knitted in parallel with the knitting of the first and second knitting regions; and the knitting for the first and second knitting regions to be overlapped with each other is performed after the stitch loops of the fold-back knitting fabric part are subjected to the bind-off process. According to this construction, after the stitch loops of the fold-back knitting fabric are bound off, the first knitting fabric and the second knitting fabric are put in the state of being overlapped with each other in front and back at the connecting part and then are connected together. This can produce a pleat formed by the first and second knitting fabrics and the fold-back knitting fabric being triply overlapped.

Other and further objects, futures and advantages of the invention will appear more fully from the following description taken in connection with the accompanying drawings.

DESCRIPTION OF THE PREFERRED EMBODIMENTS

In the following, the preferred embodiments of the invention will be described with reference to the accompanying drawings. In the illustrated embodiments, the flat knitting machine is used which is so constructed that the stitch-loop-holding knitting that can allow a stitch loop to be held in the hook of the needle proper as well as on the tongue of the slider can be effected between the arrays of knitting needles mounted on at least a pair of spaced apart front and back needle beds and which is provided with two knitting cam systems which are arranged in different phases with respect to the traveling direction of a carriage, for allowing the needles on the needle beds to move forward and backward.

Figure 1:
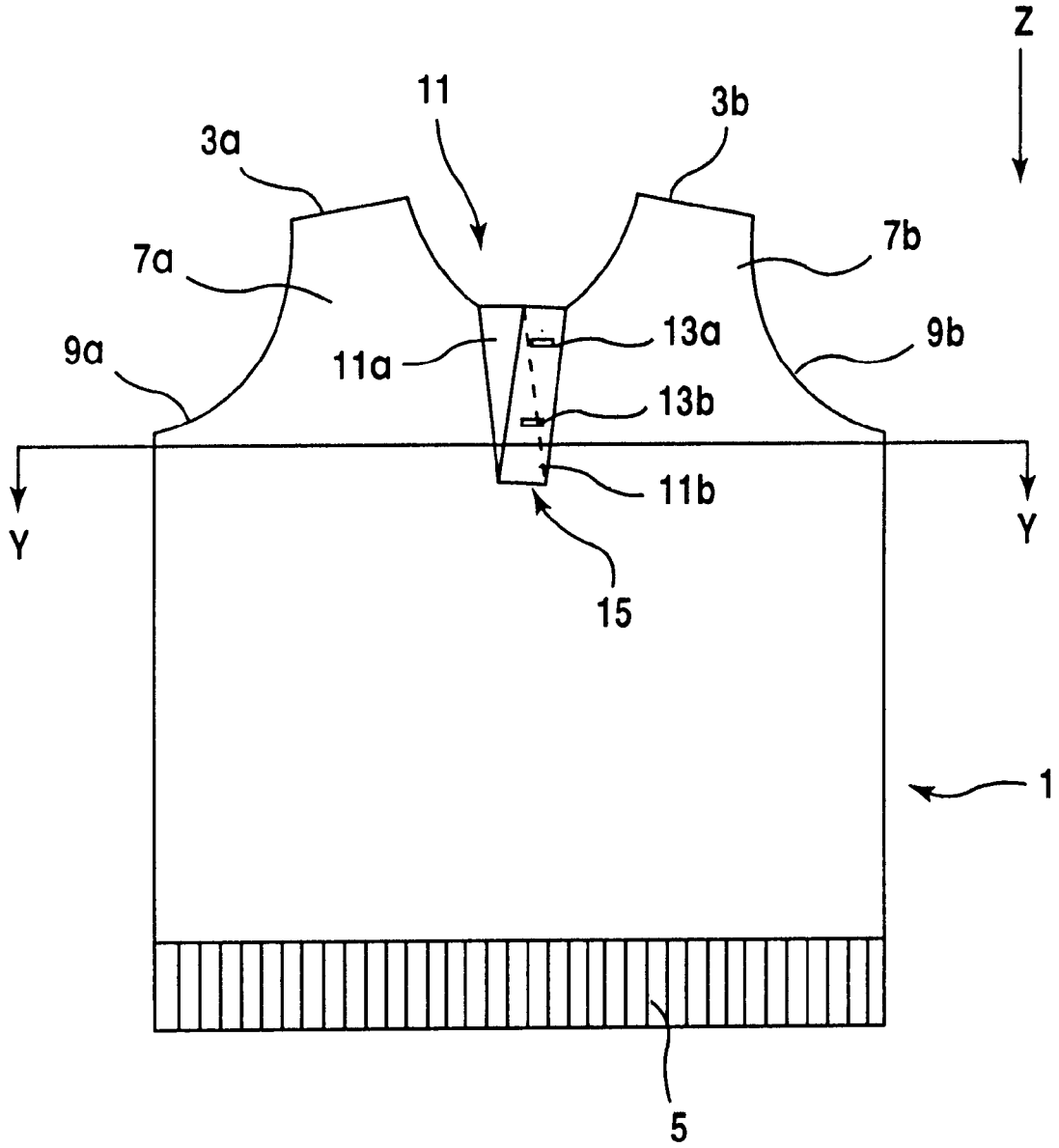
FIG. 1 is a showing of a front body of a polo shirt knitted by use of a connecting part forming method of the present invention.
Figure 2:
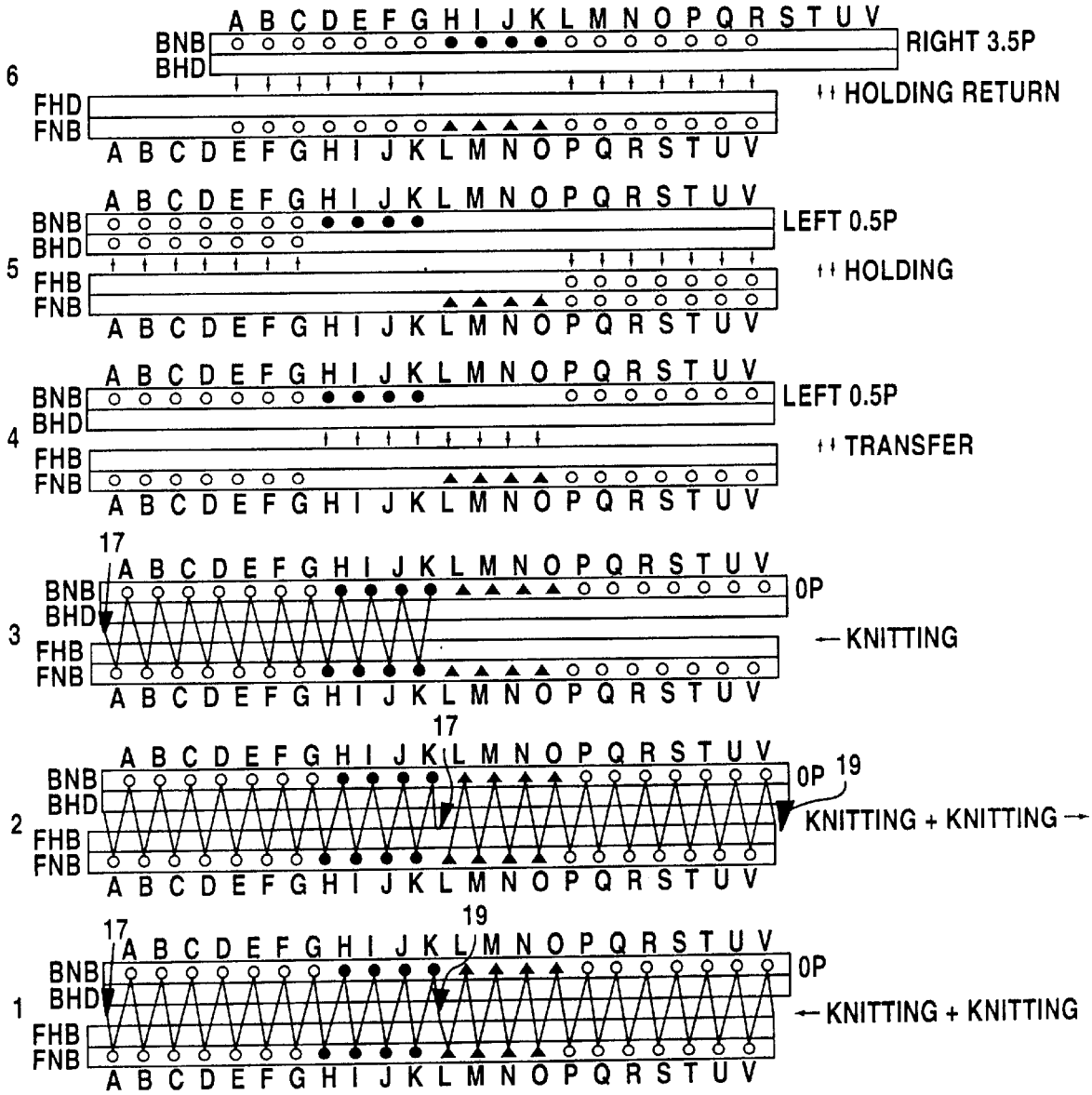
FIG. 2 shows diagrams of knitting courses of the first embodiment.

The first embodiment of the present invention will be described below with reference to FIGS. 1–3. Taking a front body 1 of a polo shirt as shown in FIG. 1 as an example, the knitting method of the first embodiment is described. In the following description, for the sake of simplicity, the knitting using only an even smaller number of knitting needles than those used in the actual knitting is taken as an example. The numeric characters at the left side of the drawing figures indicate the number of knitting courses. The horizontal arrows at the right side of the drawing figures indicate the traveling direction of the carriage and the vertical arrows indicate the direction of transferring stitch loops. The numeric characters at the right side of the front needle bed FNB and the back needle bed BNB each indicate a pitch from the origin in which the back needle bed BNB is in the state of being racked rightward by a 0.5 pitch with respect to the front needle bed FNB, as shown in the course 1. Shown in the FNB are stitch loops retained in the hooks of the needles on the front needle bed. Shown in the FHD are stitch loops held on the sliders of the needles on the front needle bed. Shown in the BNB are stitch loops retained in the hooks of the needles on the back needle bed. Shown in the BHD are stitch loops held on the sliders on the back needle bed.

The front body 1 of the polo shirt shown in FIG. 1 are knitted to the direction indicated by an arrow Z. After setting up the shoulder parts 3*a,* 3*b* with the use of knitting needles in different regions and different yarn feeders, the knitting proceeds toward a rib hem part 5. The front body is formed in the knit structure including a double jersey stitch structure, such as a Milano-rib structure or a rib structure, using the needles on both the front needle bed and the back needle bed. The front body 1 is formed by separately knitted, right and left, front body parts 7*a* and 7*b* being connected together. Armholes 9*a,* 9*b* and fly parts 11*a,* 11*b* are formed in the right and left front body parts 7*a,* 7*b,* respectively. Buttonholes 13*a,* 13*b* are formed in the fly part 11*b* of the left front body 7*b* in a known knitting method. After the completion of the form of the fly 11, the right and left fly parts 11*a,* 11*b* are overlapped in front and back and combined with each other at the connecting part 15 and the right and left front body parts 7*a,* 7*b* are knitted into a sheet of knitting fabric by using a single yarn feeder. It is noted that although the fly 11 is originally formed in the knit structure of low stretchability such as a Milano-rib structure, for the sake of simplicity, in the following description, the knitting of the polo shirt whose fly 11 is also formed with the full-rib-knit structure is taken as an example.

According to the invention, the right and left front body parts 7*a,* 7*b,* which were each knitted in the rib knitting as a separate knitting fabric, are connected together in the state in which they are overlapped with each other, to form a sheet of knitting fabric. Accordingly, in the following description, the knitting of the course on and after line Y—Y from which the connecting part between the right front body part 7*a* and the left front body part 7*b* is just started in the first embodiment of the invention will be described with reference to FIGS. 2–3 showing the knitting course diagrams. In the course 1 of FIG. 2, stitch loops of the right front body part 7*a* are retained in needles A-K on both the front needle bed and the back needle bed and stitch loops of the left front body part 7*b* are retained in needles L-V on both the front needle bed and the back needle bed. The stitch loops of the fly part 11*a* of the right front body part retained in the needles H-K and the stitch loops of the fly part 11*b* of the left front body part 7*b* retained in the needles L-O are connected together at the connecting part 15. In the course 1, after a carriage (not shown) is moved leftward, a yarn is fed to the needles K-A on both the front needle bed and the back needle bed by use of a leading cam system and a yarn feeder 17 for use in knitting the right front body part, to knit the right front body part 7*a* and also a yarn is fed to the needles V-L on both the front needle bed and the back needle bed by use of a trailing cam system and a yarn feeder 19 for use in knitting the left front body part, to knit the left front body part 7*b*. In the course 2, the yarn is fed to the needles L-V on both the front needle bed and the back needle bed by use of the leading cam system and the yarn feeder 19 for use in knitting the left front body part, to knit the left front body part 7*b* and also the yarn is fed to the needles A-K on both the front needle bed and the back needle bed by use of the trailing cam system and the yarn feeder 17 for use in knitting the right front body part, to knit the right front body part 7*a*. By repetition of the alternate knitting shown in the courses 1 and 2, the right front body part 7*a* and the left front part 7*b* are knitted in the adjoining relationship.

In the subsequent course 3, the yarn is fed to the needles K-A on both the front needle bed and the back needle bed by use of the yarn feeder 17 for knitting the right front body and then the yarn feeder 17 for use in knitting the right front body part is moved to a left side of the knitting region to get out of the knitting way. In the course 4 in which the connecting part 15 is formed, after the back needle bed BNB is racked leftward by a 0.5 pitch, the stitch loops of the right front body part 7*a* at the connecting part 15 which are retained in the needles H-K on the front needle bed FNB are transferred to the needles H-K on the back needle bed BNB via the leading cam system and the stitch loops of the left front body part 7*b* which are retained by the needles L-O on the back needle bed BNB are transferred to the needles L-O on the front needle bed FNB via the trailing cam system. Then, in the course 5, the stitch loops of the right front body part 7*a* which are retained in the needles A-G on the front needle bed FNB are held on the needles A-G on the back needle bed BNB via the leading cam system, and the stitch loops of the left front body part 7*b* which are retained in the needles P-V on the back needle bed BNB are held on the needles P-V on the front needle bed FNB via the trailing cam system. As a result of this, all the stitch loops of the right front body part 7*a* are retained by the needles on the back needle bed BNB and all the stitch loops of the left front body part 7*b* are retained on the needles on the front needle bed FNB. In the course 6, the back needle bed BNB is racked to a 3.5-pitch rightward position so that the stitch loops of the right front body part 7*a* at the connecting part 15 which are retained in the needles H-K on the back needle bed BNB and the stitch loops of the left front body part 7*b* at the connecting part 15 which are retained in the needles L-O on the front needle bed FNB can be opposed to each other in back and front. Then, the stitch loops of the right front body part 7*a* held on the needles A-G on the back needle bed BNB are returned to the needles E-K on the front needle bed FNB via the leading cam system, and the stitch loops of the left front body part 7*b* held on the needles P-V on the front needle bed FNB are returned to the needles L-R on the back needle bed BNB via the trailing cam system.

Figure 3:
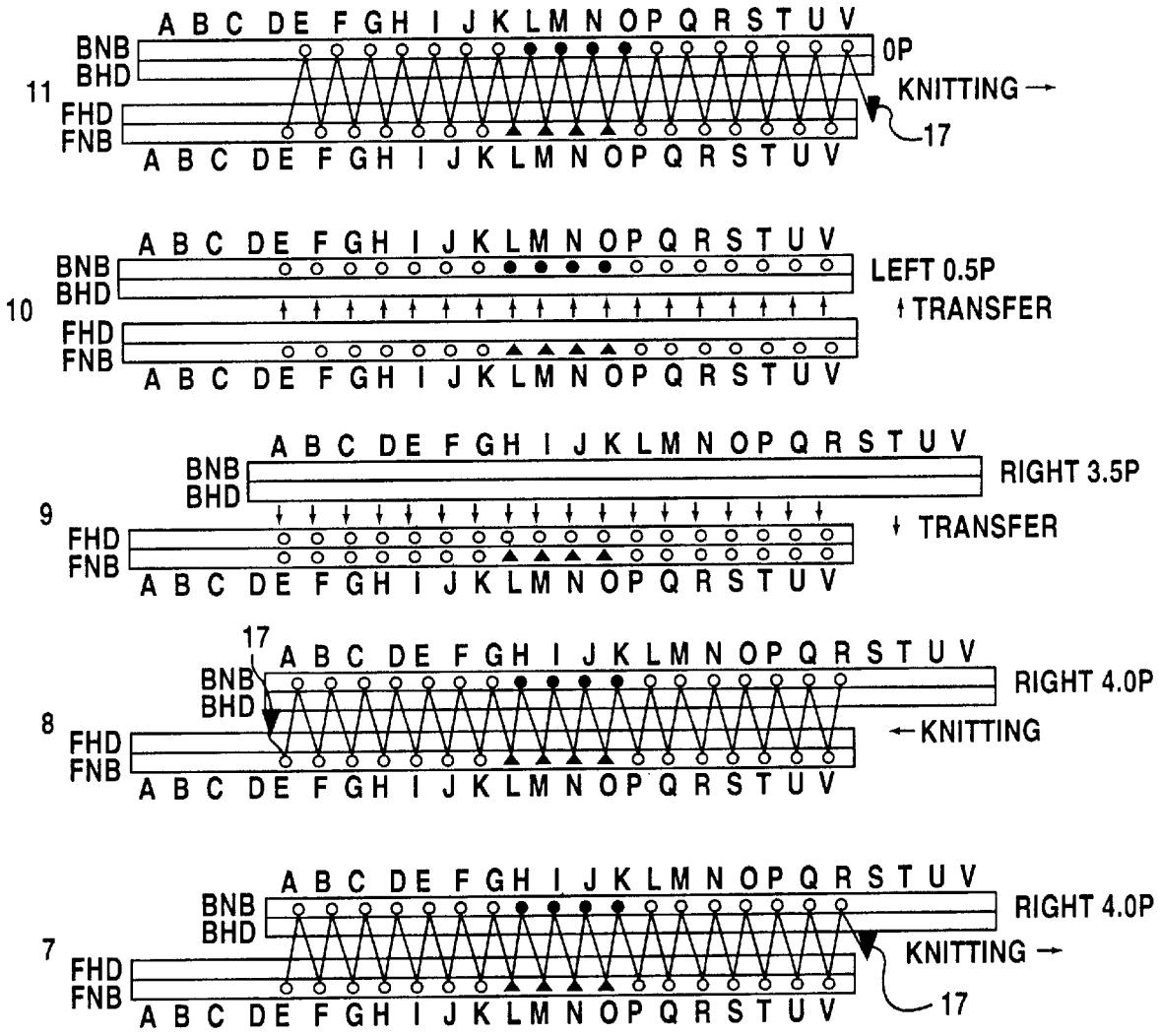
FIG. 3 shows diagrams of knitting courses of the first embodiment.

Then, in the course 7 of FIG. 3, after the back needle bed BNB is racked to a 4-pitch rightward position, the yarn is fed to the needles E-V on the front needle bed FNB and the needles A-R on the back needle bed BNB alternately via the yarn feeder 17 used for the knitting of the right front body part 7*a,* to form the rib stitch, and thereby the right front body part 7*a* and the left body part 7*b* are connected to each other at the connecting part 15. In the course 8, the yarn feeder is shifted leftward to feed the yarn to the needles R-A on the back needle bed BNB and the needles V-E on the front needle bed FNB, to form the rib stitch. Thereafter, the knitting of the courses 7 and 8 are repeated to form four rib stitch courses in total.

In the subsequent course 9, after the back needle bed BNB is racked to a 3.5-pitch rightward position, the stitch loops retained by the needles A-R on the back needle bed BNB are held on the needles E-V on the front needle bed FNB so that all the stitch loops can be retained by the front needle bed FNB. Then, in the course 10, after the back needle bed BNB is racked to a 0.5-pitch leftward position, the stitch loops held on the needles E-V on the front needle bed FNB are returned to the needles E-V on the back needle bed BNB, so that the back needle bed BNB is returned to the previous position before proceeding to form the connecting part 15. In the course 11, the yarn is fed to the needles E-V on the front needle bed FNB and the needles E-V on the back needle bed BNB by use of the yarn feeder 17 to proceed to knit the front body 1 toward the rib hem part 5. While the first embodiment above gives the example that the right front body part 7*a* is shifted toward the left front body part 7*b* to form the fly 11, modification may be made, such as, shifting the left front body part 7*b* toward the right front body part 7*a* to form the fly 11.

Figure 4:
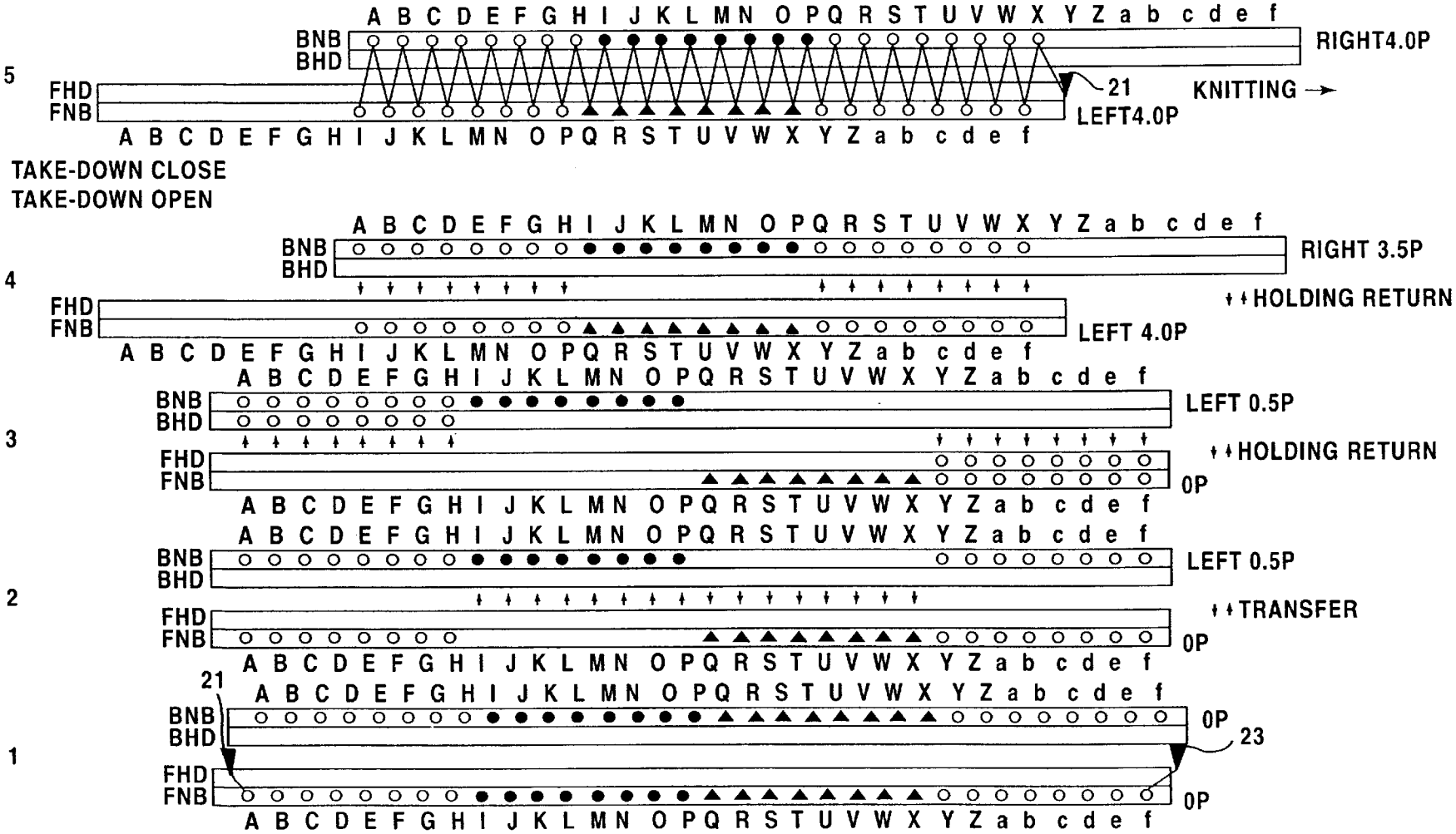
FIG. 4 shows diagrams of knitting courses of the second embodiment.
Figure 5:
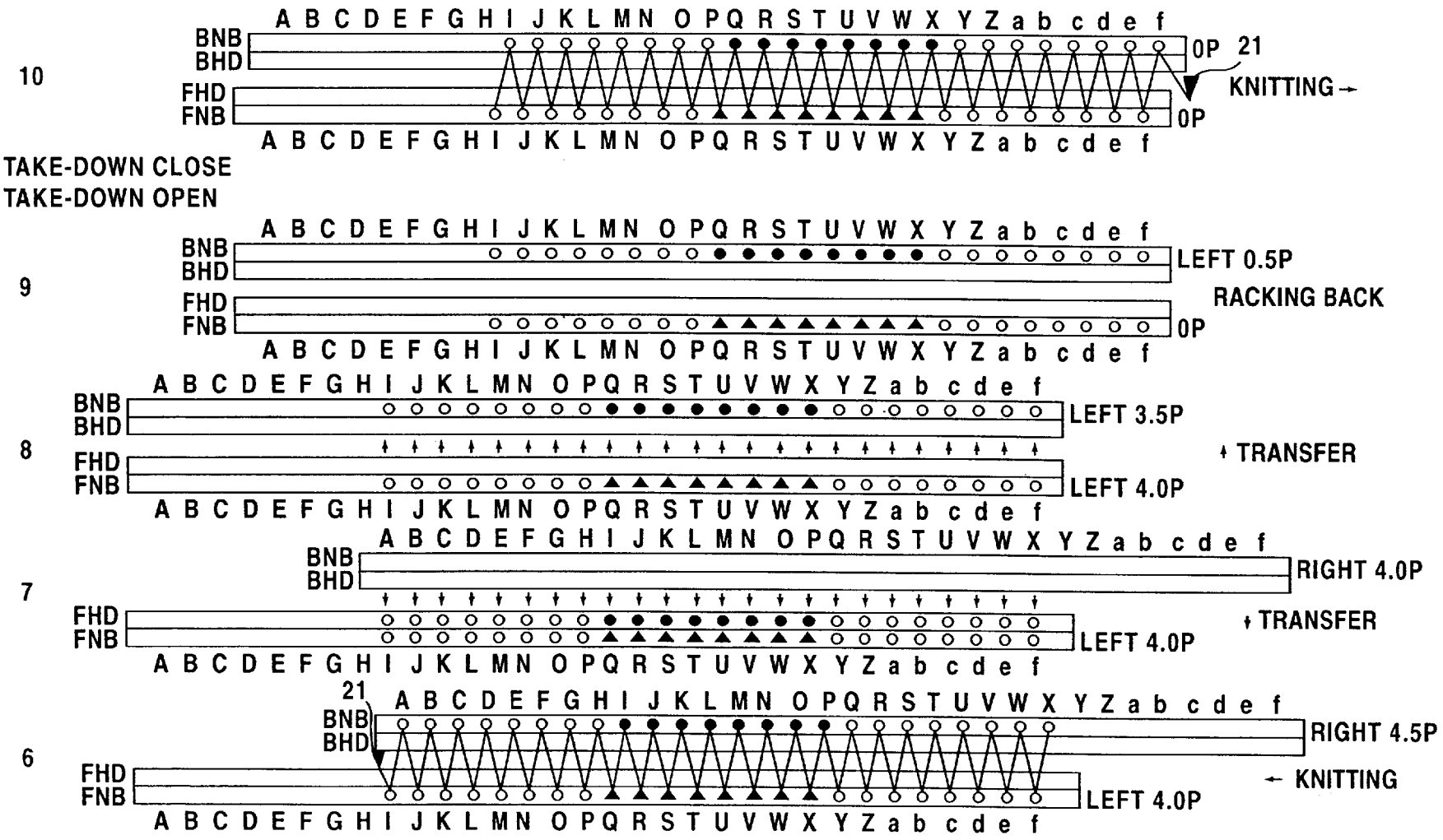
FIG. 5 shows diagrams of knitting courses of the second embodiment.

Next, the second embodiment will be described with reference to FIGS. 4–5. While the first embodiment illustrates the example that the back needle bed BNB is required to be racked within the maximum racking pitch thereof, for allowing the right front body part 7*a* and the left front body part 7*b* to be overlapped with each other, the second embodiment illustrates the example that the racking of both the front needle bed and the back needle bed are required for forming the connecting part 15 having a width larger than that of the connecting part of the first embodiment. As the knitting of the second embodiment has commonality in the knitting of the courses 1–3 with the knitting of the first embodiment, the explanation will start from the stage of the completion of the knitting of the courses 1–3 in the first embodiment. In the course 1 of FIG. 4, the stitch loops of the right front body part 7*a* are retained on the needles A-P on both the front needle bed and the back needle bed, and the stitch loops of the left front body part 7*b* are retained on the needles Q-f on both the front needle bed and the back needle bed. The yarn feeder 21 for use in knitting the right front body part is at rest at the left side and the yarn feeder 23 for use in knitting the left front body part is at rest at the right side.

In the second embodiment, the stitch loops of the fly 11*a* of the right front body part 7*a* retained on the needles I-P on the front and back needle beds and the stitch loops of the fly 11*b* of the left front body part 7*b* retained on the needles Q-X on the front and back needle beds are overlapped with each other. In the course 2, the stitch loops of the right front body part 7*a* retained on the needles I-P on the front needle bed FNB are transferred to the needles I-P on the back needle bed BNB and also the stitch loops of the left front body part 7*b* retained on the needles Q-X on the back needle bed BNB are transferred to the needles Q-X on the front needle bed FNB. In the course 3, the stitch loops of the right front body part 7*a* except the fly 11*a,* which are retained on the needles A-H on the front needle bed FNB, are held on the needles A-H on the back needle bed BNB, and the stitch loops of the left front body part 7*b* except the fly 11*b,* which are retained on the needles Y-f on the back needle bed BNB, are held on the needles Y-f on the front needle bed FNB. In the course 4, the needle beds are racked so that the fly 11*a* of the right front body part 7*a* and the fly 11*b* of the left front body part 7*b* can be opposed to each other in back and front. Since the required racking pitch exceeds the maximum racking pitch of the front needle bed FNB or the back needle bed BNB alone, the front needle bed FNB is racked to a 4-pitch leftward position and also the back needle bed BNB is racked to a 3.5-pitch rightward position. If a large racking is required for allowing the fly 11*a* of the right front body part 7*a* and the fly 11*b* of the left, front body part 7*b* to be opposed to each other in back and front, deviation from proper alignment between the region for the loops to be formed and the region for the knitting fabric to be captured by the knitting fabric take-down apparatus will be caused to prevent a uniform take-down tension on the knitting fabric. In this circumstance, it is preferable that after being released from the knitting fabric take-down apparatus for a while, the knitting fabric is captured again and taken down. This enables the deviation to be corrected and permits the knitting fabric to hang over directly below the part of the knitting fabric in which the loops are being formed, so that a uniform take-down tension can be applied on the whole knitting region of the knitting fabric. In the course 5, after the back needle bed BNB is racked to a 4-pitch rightward position, the yarn is fed to the needles I-f on the front needle bed FNB and the needles A-X on the back needle bed BNB via the yarn feeder 21 for use in knitting the right front body part, to connect the fly 11*a* of the right front body part 7*a* with the fly 11*b* of the left front body part 7*b* so as to form the connecting part 15. In the course 6 of FIG. 5, the yarn is fed to the needles f-I on the front needle bed FNB and the needles X-A on the back needle bed BNB via the yarn feeder 21 to knit the rib stitch and, thereafter, the knitting shown in the courses 5 and 6 are repeated again to form four rib stitch courses.

In the course 7, in order that both the front needle bed and the back needle bed can be returned to their original positions, the stitch loops retained in the needles A-X on the back needle bed BNB are held on the needles I-f on the front needle bed FNB. In the course 8, after the back needle bed BNB is racked to a 3.5-pitch leftward position so that the front and back needle beds can be opposed to each other, the stitch loops as held on in the course 7 are transferred back to the back needle bed BNB. In the course 9, in the state in which the front and back needle beds are in opposition to each other, the front needle bed FNB is racked until it reaches the origin point of the racking. If necessary, prior to going to the knitting of the course 10, the knitting fabric take-down apparatus is operated to do the release and capture of the knitting fabric, for correction of the deviation of the knitting fabric. Then, in the course 10, the back needle bed BNB is racked back to the origin point of the racking and the yarn is fed to the needles I-f on both the front needle bed and the back needle bed via the yarn feeder 21 for use in knitting the right front body part to knit the right front body part 7*a* and the left front body part 7*b* into a sheet of knitting fabric.

Figure 6A:
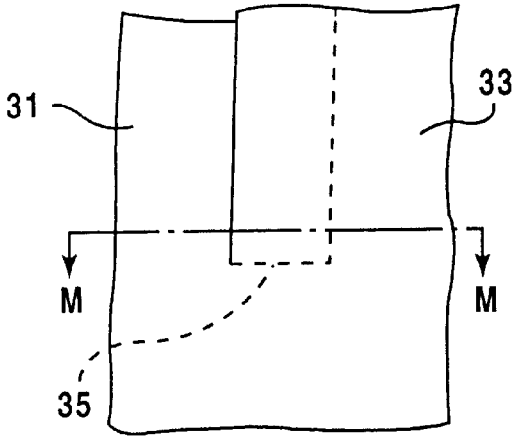
FIG. 6A is an enlarged view of a connecting part of the fabric knitted in accordance with the first and second embodiments.
Figure 6C:
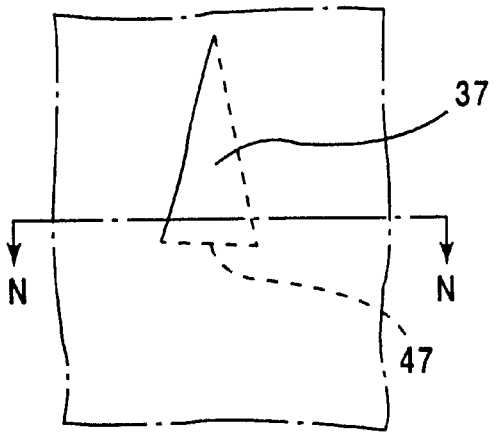
FIG. 6C is a partly enlarged view of a connecting part of the fabric knitted in accordance with the third embodiment.
Figure 6B:
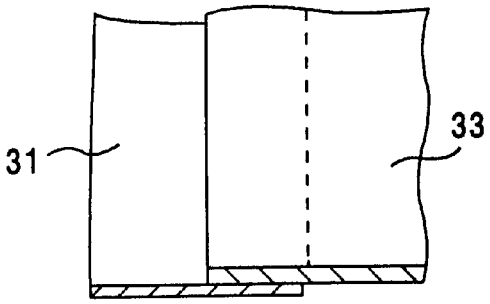
FIG. 6B is a sectional view taken on line M—M of FIG. 6A.
Figure 6D:
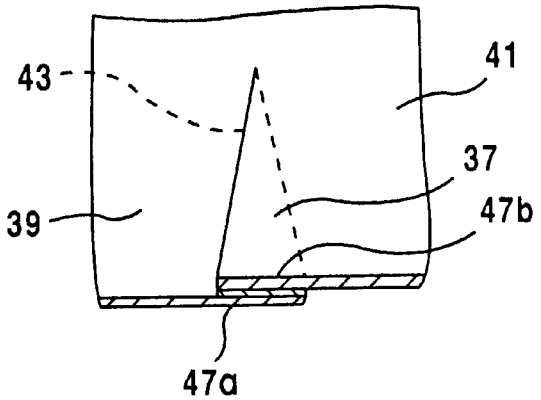
FIG. 6D is a sectional view taken on line N—N of FIG. 6C.

Next, the third embodiment of the invention will be described with reference to FIGS. 6–9. While the above-illustrated first and second embodiments illustrate the example that the separately knitted, first and second knitting fabrics 31, 33 are connected together to form the connecting part 35, as shown in FIG. 6A and FIG. 6B which is a sectional view taken along a chain line M—M of FIG. 6A, the third embodiment illustrates the example that parts of the same knitting fabric which are knitted with the use of the needles belonging in different regions are connected together to form pleats 37 as shown in FIG. 6C, as shown in FIG. 6C and FIG. 6D which is a sectional view taken along a chain line N—N of FIG. 6C. While the knitting fabric formed in accordance with the first and second embodiments comes into a state in which the first knitting fabric and the second knitting fabric are doubly overlapped, the knitting fabric formed in accordance with the third embodiment comes into a three thickness fabric in which a first knitting region 39, a second knitting region 41 and a fold-back region 43 formed between the first knitting region and the second knitting region are overlapped with each other. Description will be given below with reference to FIGS. 7–9 showing diagrams of knitting courses.

Figure 7:
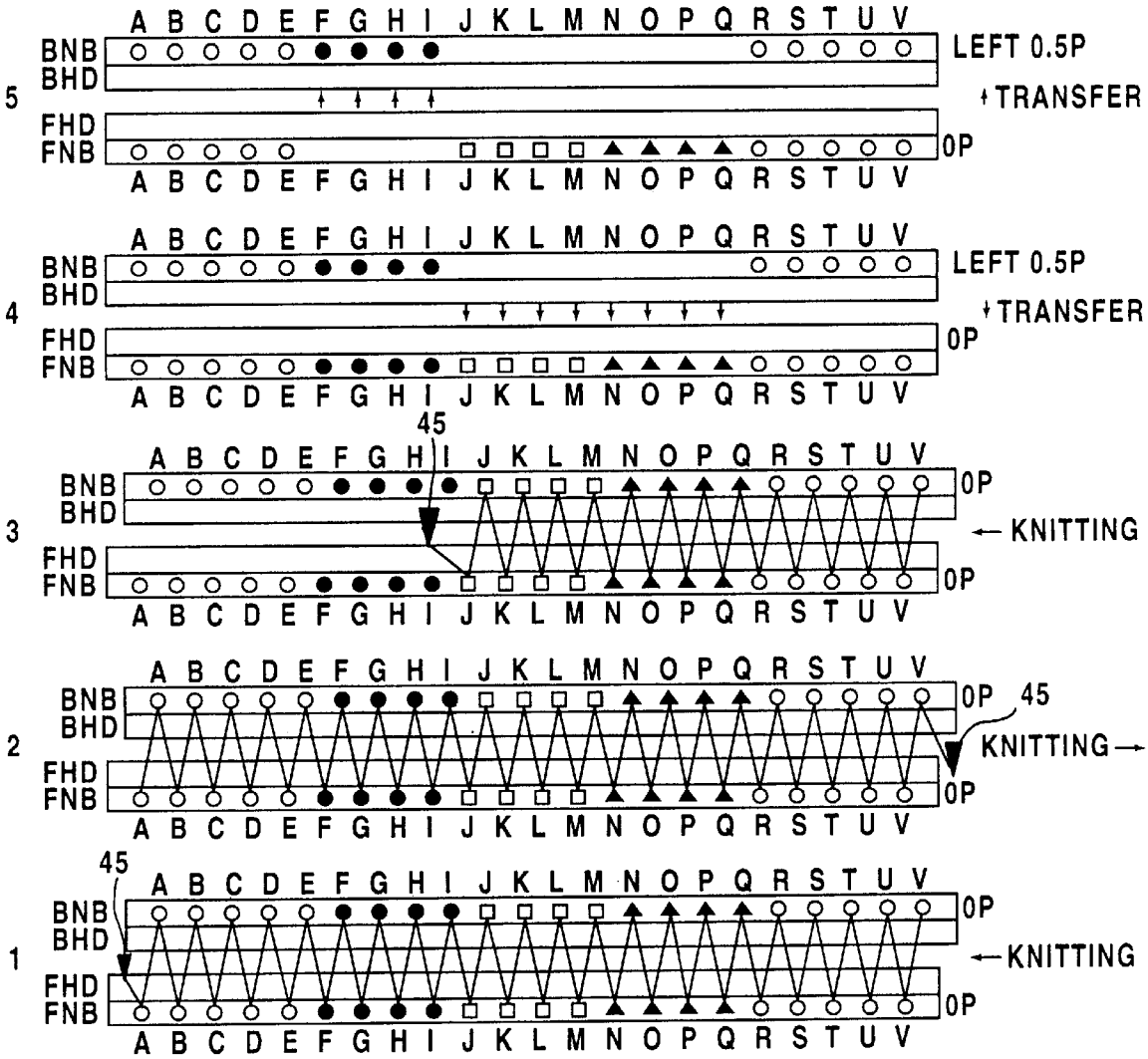
FIG. 7 shows diagrams of knitting courses of the third embodiment.

In the course 1 of FIG. 7, the stitch loops retained in the needles A-I on both the front needle bed and the back needle bed are the stitch loops belonging in the first knitting region 39. Of these stitch loops, those retained by the needles F-I are the loops of the connecting part 47*a* to be overlapped with the second knitting region 41; those retained by the needles J-M on both the front needle bed and the back needle bed are the loops belonging in the fold-back knitting region 43; and those retained by the needles N-V on both the front needle bed and the back needle bed are the loops belonging in the second knitting region 41. Of these loops, the stitch loops retained by the needles R-V are the loops of the connecting part 47*b* to be overlapped with the first knitting region.

In the third embodiment, a single yarn feeder 45 is used, which is reversed in direction to feed the yarn to the needles A-V on both the front needle bed and the back needle bed, as shown in the courses 1 and 2, so as to knit the first knitting region 39, the fold-back knitting region 43 and the second knitting region 41. In the course 3, the yarn is fed to the needles V-J on both the front needle bed and the back needle bed and then the yarn feeder 45 is shifted to the left side of the fold-back knitting region 43. In the course 4, the stitch loops of the fold-back knitting region 43 which are retained in the needles J-M on the back needle bed BNB and the stitch loops of the second knitting region 41 at the connecting part 47*b* which are retained in the needles N-Q on the back needle bed BNB are transferred to the needles J-Q on the front needle bed FNB, to be overlapped with the loops retained by the needles J-Q on the front needle bed FNB. In the subsequent course 5, the stitch loops of the first knitting region at the connecting part 47*a* which are retained in the needles F-I on the front needle bed FNB are transferred to the needles F-I on the back needle bed BNB, to be overlapped with the loops retained in the needles F-I on the back needle bed BNB.

Figure 8:
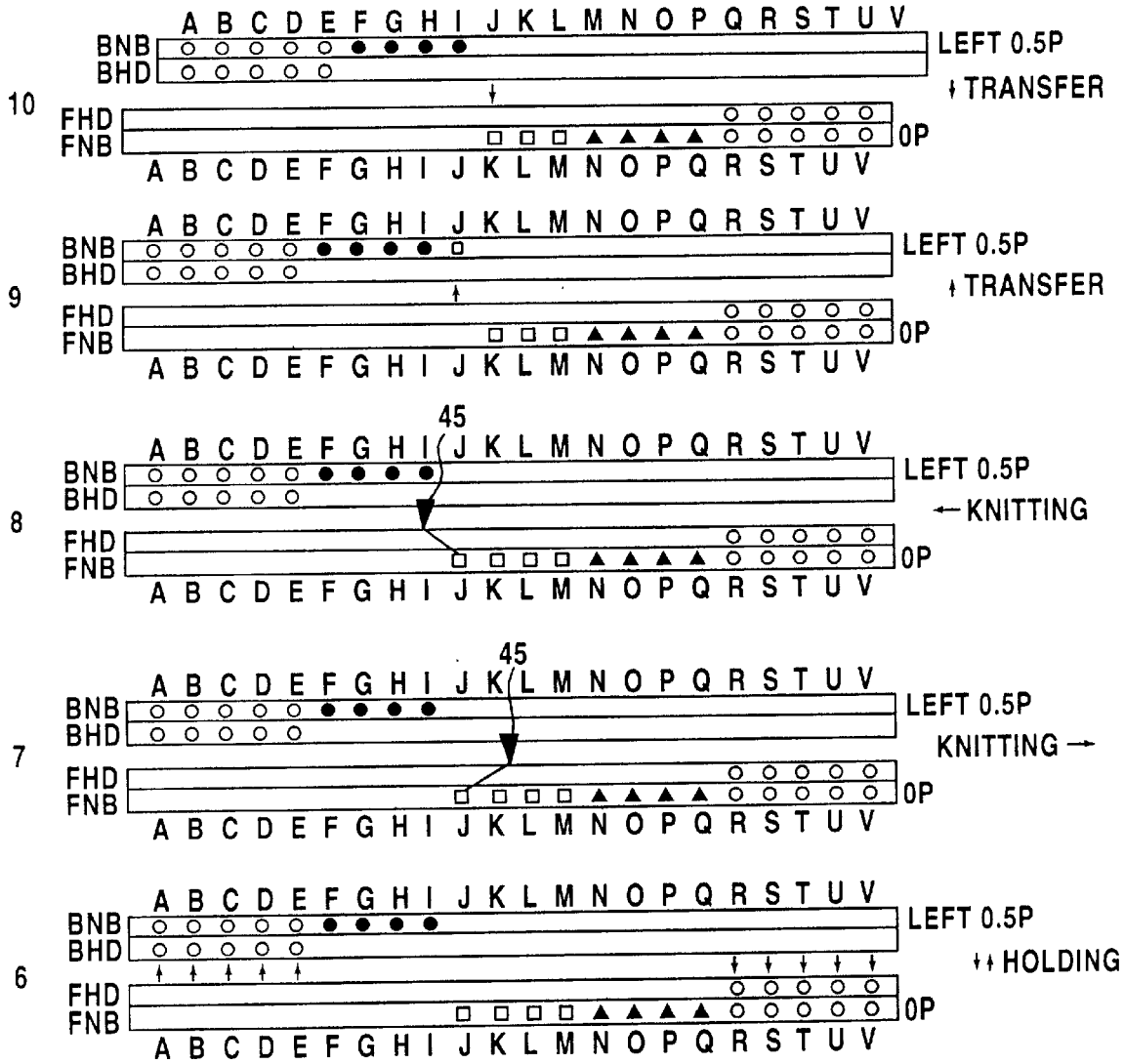
FIG. 8 shows diagrams of knitting courses of the third embodiment.
Figure 9:
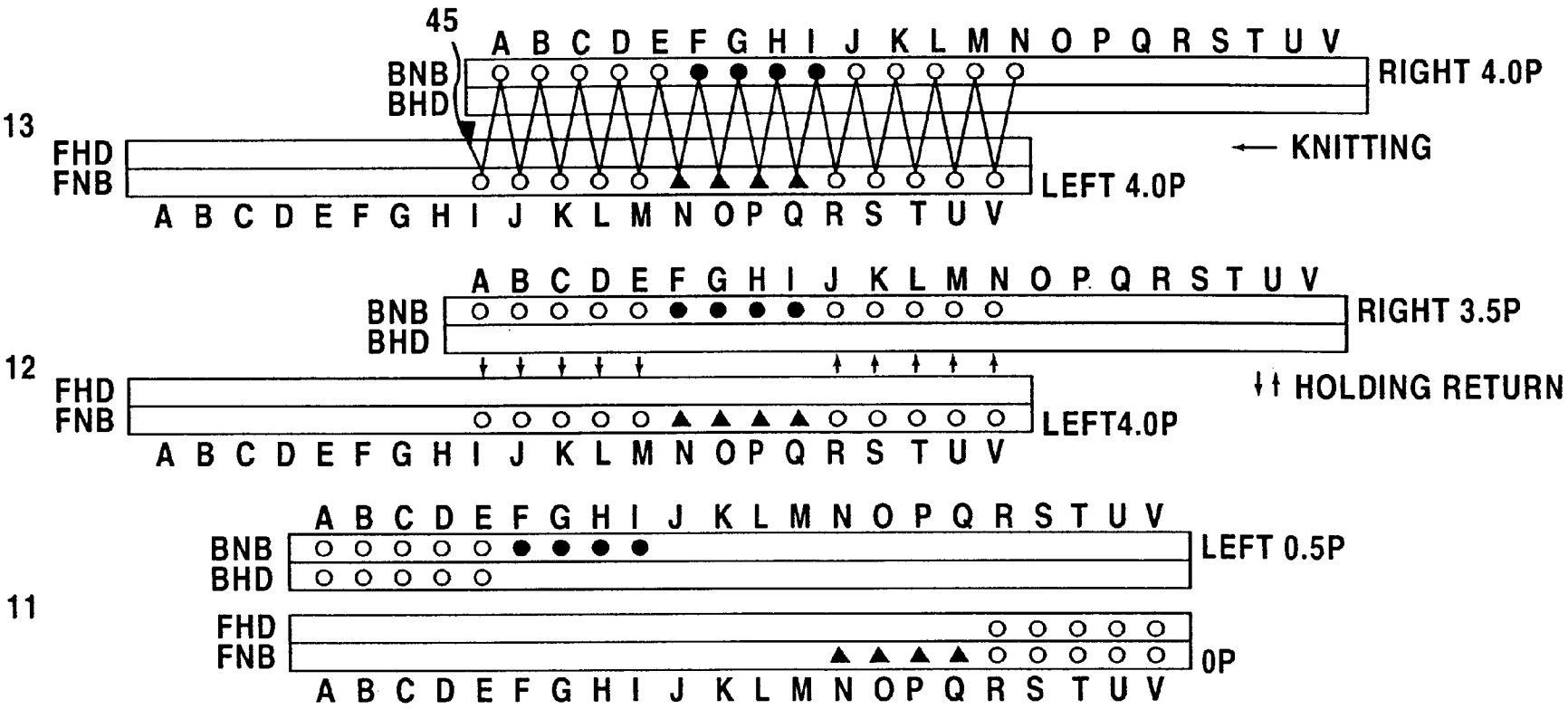
FIG. 9 shows diagrams of knitting courses of the third embodiment.
Figures 10A, 10B, 10C, 10D:
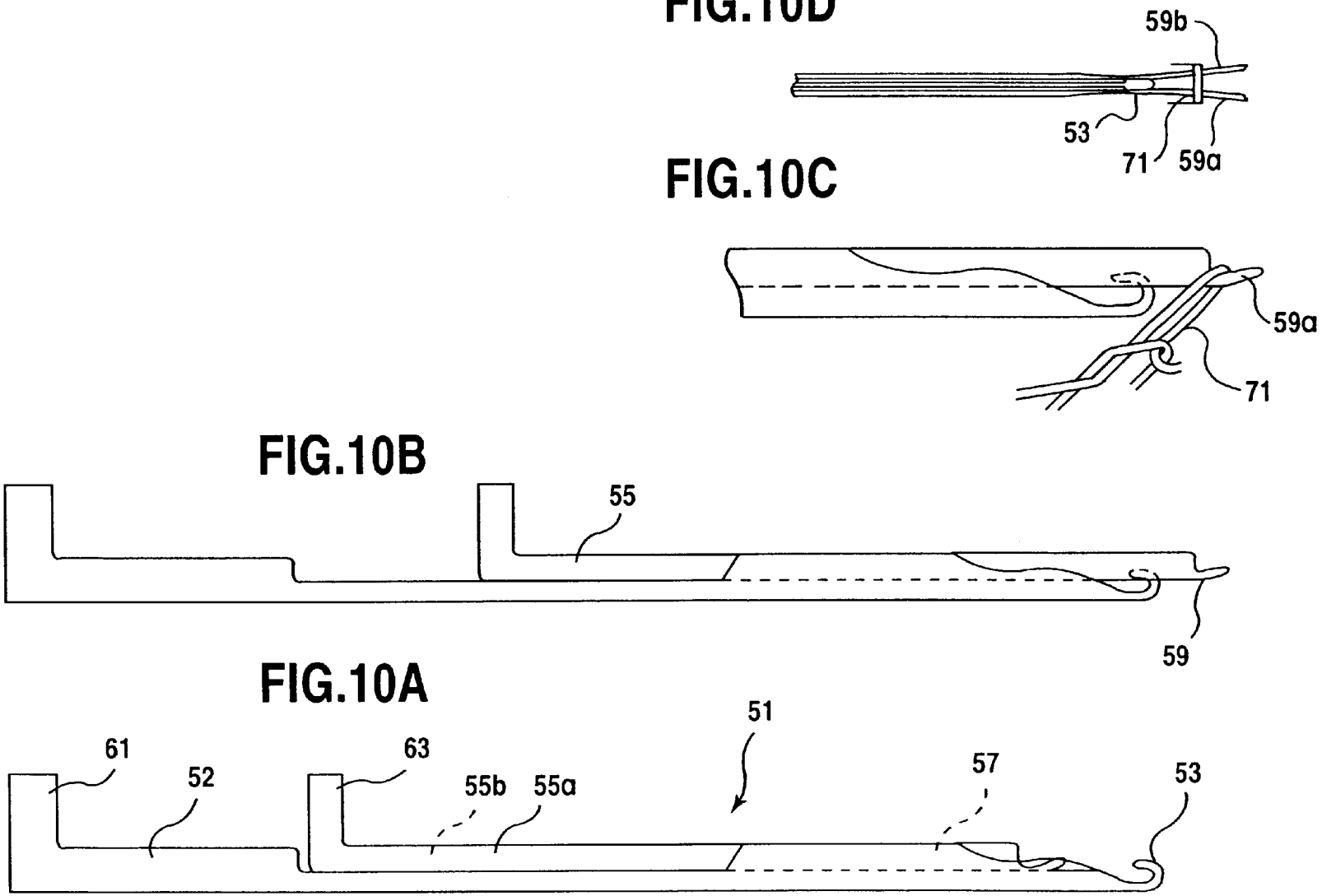
FIG. 10 is a showing of a knitting needle for use in the stitch-loop-holding knitting.
Figure 11A:
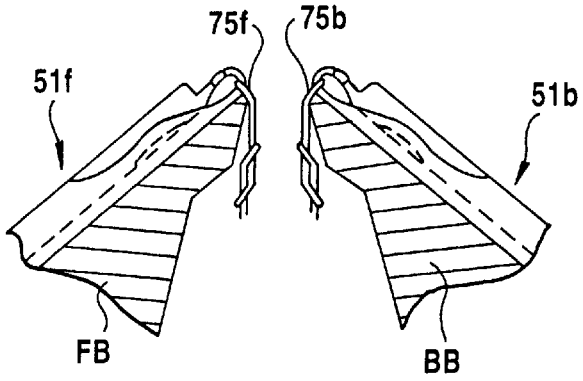
FIG. 11 is a showing of one example of the stitch-loop-holding knitting using the knitting needles of FIG. 10.
Figure 11B:
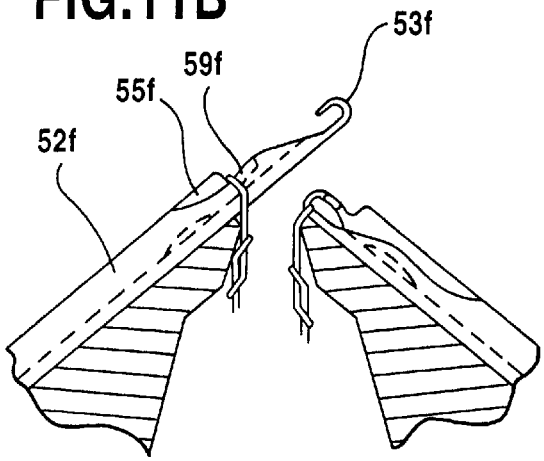
Figure 11C:
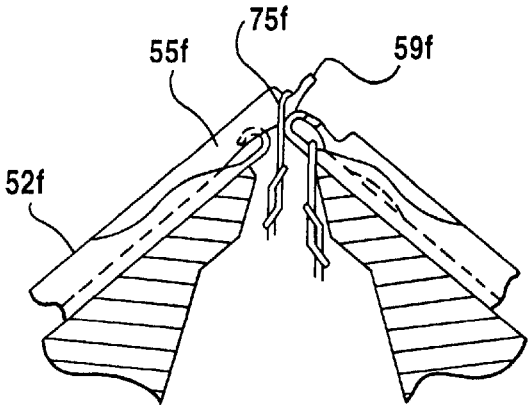
Figure 11D:
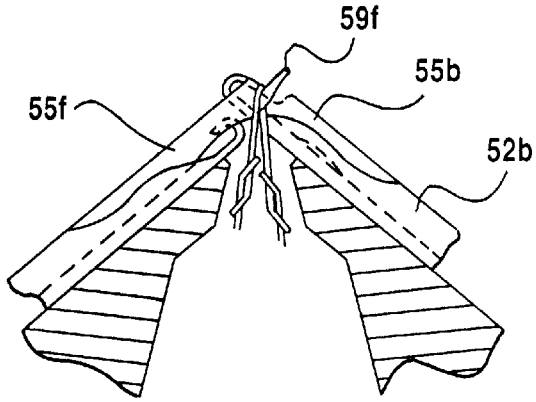
Figure 11E:
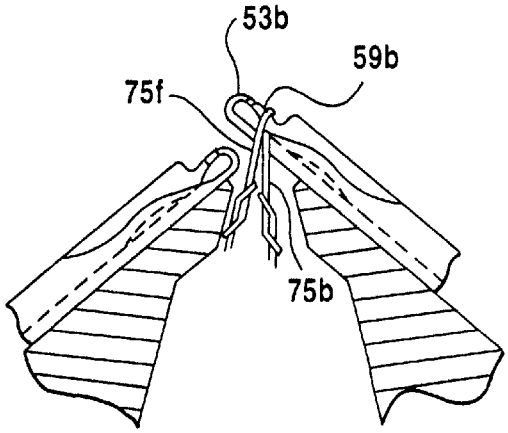
Figure 12A:
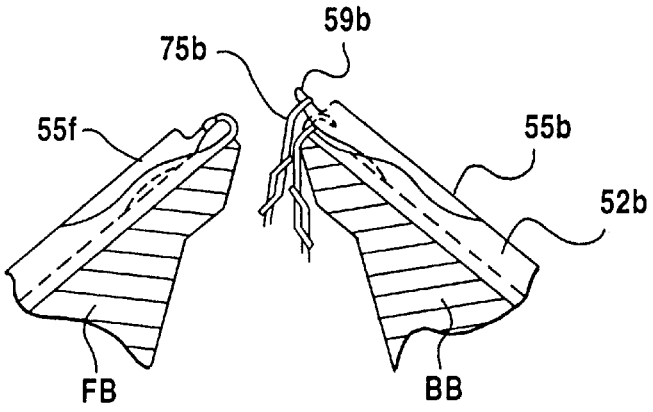
FIG. 12 is a showing of one example of the stitch-loop-holding knitting using the knitting needles of FIG. 10.
Figure 12D:
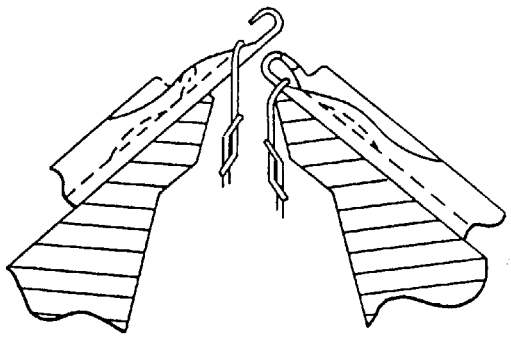
Figure 12B:
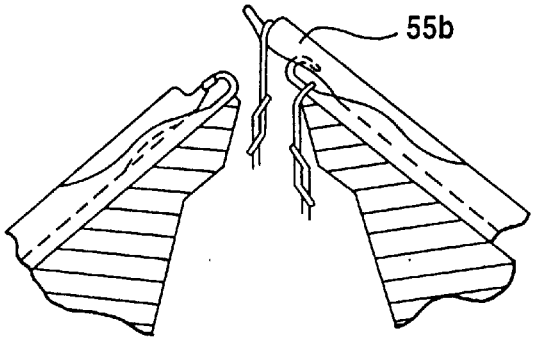
Figure 12E:
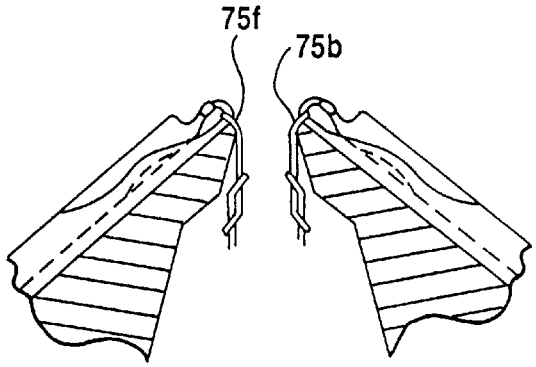
Figure 12C:
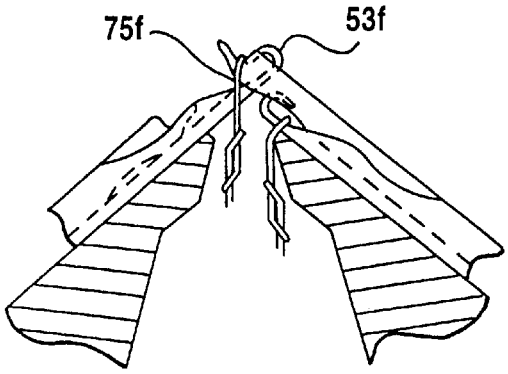

In the course 6 of FIG. 8, the stitch loops of the first knitting region 39 which are retained in the needles A-E on the front needle bed FNB are held on the needles A-E on the back needle bed BNB and the stitch loops of the second knitting region 41 which are retained in the needles R-V on the back needle bed BNB are held on the needles R-V on the front needle bed FHD, so that all the stitch loops of the first knitting region 39 are retained by the needles on the front needle bed FNB and all the stitch loops of the second knitting region 41 are retained by the needles on the back needle bed BNB. Then, in the course 7, the yarn is fed to the needle J on the front needle bed FNB to form a stitch loop of the next course on the stitch loops of the fold-back knitting region 43. In the course 8 as well, a stitch loop of the next course is formed in a similar manner. In the course 9, the stitch loop newly formed in the courses 8 are transferred to the needle J on the back needle bed BNB. In the course 10, after the back needle bed BNB is racked to a 0.5-pitch rightward position, the stitch loop retained in the needle J on the back needle bed BNB is transferred to the needle K on the front needle bed FNB to be overlapped with the stitch loop of the fold-back knitting region 43. From this course forward, as shown in the courses 7–10, the knitting in which the stitch loop newly formed in the fold-back knitting region 43 is overlapped with the adjoining stitch loop of the fold-back knitting region 43 so that the stitch loop of the next course is formed at the overlapped loops is repeated from one end side of the fold-back knitting region 43 toward the other end side of the same, to perform the bind-off process in which the stitch loops of the fold-back knitting region 43 are disengaged from the corresponding needles. As a result of this, all the stitch loops of the fold-back knitting region 43 are disengaged from the corresponding needles, as shown in the course 11 of FIG. 9.

In the course 12, after the front needle bed FNB is racked leftward by 4 pitches and the back needle bed BNB is racked rightward by 3.5 pitches so that the stitch loops of the first knitting region 39 at the connecting part 47*a* and the stitch loops of the second knitting region 41 of the connecting part 47*b* can be opposed to each other, the stitch loops of the first knitting region 39 which are held on the needles A-E on the back needle bed BNB and the stitch loops of the second knitting region 41 which are held on the needles R-V on the front needle bed FNB are transferred back to their opposed needle beds, respectively. Then, in the course 13, the yarn is fed to the needles V-I on the front needle bed FNB and the needles N-A on the back needle bed BNB via the yarn feeder 45 to connect the first knitting region 39 with the second knitting region 41, so as to form pleats 37 as shown in FIGS. 6-C and 6-D. The pleats 37 formed by the knitting method above become neither rigid nor bulky at the connecting part 47, because the final course in the fold-back knitting region is sandwiched between the first knitting region 39 and the second knitting region 41, rather than being connected thereto, as is the case with the pleats formed by the method of JP Patent Publication No. Hei 7(1995)-111021.

While in the above-illustrated embodiments the formation of the fly in the front body parts of the polo shirt is given as an example, the present invention is may be applied to the knitting of a variety of knitwear without limiting to the above-illustrated embodiments. Also, while in the above-illustrated embodiments the application of the invention to the two-bed flat knitting machine having a pair of oppositely arranged front and back needle beds is given as an example, the present invention can be practically applied in a three-bed flat knitting machine or a four-bed flat knitting machine in which a transfer jack bed or an upper needle bed is provided on a pair of lower needle beds or a flat knitting machine having any number of cam systems other than two cams. Further, while in the above-illustrated embodiments the stitch loops are held directly on the knitting needles between the both needle beds, the stitch loops may alternatively be transferred from one knitting needles to the transfer jacks on the transfer jack bed and in turn transferred from the transfer jacks to the other knitting needles, whereby the stitch loops are held on the opposed knitting needles. Further, the bind-off process can be performed in various processes without limiting to the bind-off process described above. Also, while in the above-illustrated embodiments the knitting fabric is knitted in the full-rib-knit structure, the present invention can be applied to the knitting of the knit structure including a double jersey stitch structure, such as a Milano-rib structure or a wide rib structure, without limiting to the full-rib-knit structure. Thus, even when the knitting fabric is knitted in the other knit structure than the full-rib-knit structure, if several courses of the right and left knitting fabrics after connected together at the fly or the connecting part mentioned above are knitted in the full-rib-knit structure, the knitting fabric at the connecting part can be increased in strength.

As noted above, in the method of knitting a knitwear forming a connecting part therein according to the present invention, the first and second knitting fabrics knitted in the double jersey stitch structure are shifted in the direction of their moving close to each other in the state in which they are held on needles on different needle bed and are partly overlapped with each other in front and back and, thereafter, the first and second knitting fabrics are knitted in the double jersey stitch structure so as to be connected together. This can produce the result that the fly or the connecting part of the first and second knitting fabrics formed in the double jersey stitch structure and overlapped with each other in front and back can be formed on the knitting machine, so the subsequent treatments after the completion of knitting of the knitting fabric can be reduced.

In the case where the first and second knitting fabrics are formed by the same knitting fabric knitted by use of the needles belonging in different regions and the same yarn feeder, the fold-back knitting fabric part is knitted in the region between the first and second knitting fabrics in parallel with the knitting of the first and second knitting fabrics, and the knitting for the first and second knitting fabrics to be overlapped with each other is performed after the stitch loops of the fold-back knitting fabric part is subjected to the bind-off process, there is produced the result that the fold-back knitting region which is formed between the first knitting region knitted as the first knitting fabric and the second knitting region knitted as the second knitting fabric is sandwiched between the first knitting region and the second knitting region to form a pleat of a triply overlapped knitting fabric.

While the preferred embodiments of the invention have been described, it is to be understood that various changes and modification may be made in the invention without departing from the sprit of the present invention. The scope of the invention, therefore, is to be determined solely by the following claims.

What is claimed is:

1. A method of knitting a knitwear to form therein a connecting part of partly overlapped first and second knitting fabrics by using a flat knitting machine which comprises arrays of compound needles, each of said array of compound needles having a needle proper with a hook at a top end thereof and a slider having a tongue, said tongue comprising two thin plates wherein said needle proper and said slider can be individually moved forward and backward, and first and second needle beds mounting thereon the arrays of compound needles and oppositely arranged in front and back wherein a stitch loop is transferrable between the first and second needle beds, said tongue of said slider of a knitting needle of said compound needles retaining the stitch loop in said hook of said needle proper and is advancable into the stitch loop retained on the tongue of said slider on an opposite needle bed of said first and second needle beds to permit a stitch-loop-holding knitting that the stitch loops are held in said hook of said knitting needle as well as on said tongue of the same knitting needle, wherein the connecting part of the partly overlapped first and second knitting fabrics is formed using needles in different regions on both the front needle bed and said back needle bed, the method comprising the steps:

knitting in double jersey structure the first knitting fabric formed using needles belonging in a first region of each of the first and second needle beds and the second knitting fabric formed using needles belonging in a second region of each of the first and second needle beds;

transferring stitch loops of the first knitting fabric to be overlapped with related stitch loops of the second knitting fabric, of the stitch loops of the first knitting fabric retained in the needles on the second needle bed, and stitch loops of the second knitting fabric to be overlapped with the related stitch loops of the first knitting fabric, of the stitch loops of the second knitting fabric retained in the needles on the first needle bed, to the first needle bed and the second needle bed, respectively, to be overlapped with the related stitch loops, whereby the first knitting fabric and the second knitting fabric are divided between the first needle bed and the second needle bed;

holding stitch loops of the first knitting fabric not to be overlapped with related stitch loops of the second knitting fabric, of the stitch loops of the first knitting fabric retained in the needles on the second needle bed, and stitch loops of the second knitting fabric not to be overlapped with the related stitch loops of the first knitting fabric, of the stitch loops of the second knitting fabric retained in the needles on the first needle bed on the needles of the first needle bed and on the needles of the second needle bed, respectively, whereby the stitch loops of the first knitting fabric are retained by the needles of the first needle bed and the stitch loops of the second knitting fabric are retained by the needles of the second needle bed;

racking at least one of the first needle bed and the second needle beds in a direction of the first knitting fabric and the second knitting fabric being moved closer to each other, wherein the first and second knitting fabrics overlap each other in front and back;

transferring the stitch loops held on the needles on each of the opposed needle beds back to their original needle beds; and forming stitch loops of the next course in double jersey stitch structure in the needles belonging in the region in which the first and second knitting fabrics are retained while overlapped in front and back.

2. A method of knitting according to claim 1, wherein the first knitting fabric and the second knitting fabric are separate knitting fabrics which are knitted by using different yarn feeders.

3. A method of knitting according to claim 1, wherein the first and second knitting fabrics are formed of first and second knitting regions in the same knitting fabric knitted by using needles belonging in different regions and a common yarn feeder, wherein a fold-back knitting fabric part is knitted in parallel with the knitting of the first and second knitting regions, and wherein the knitting for the first and second knitting regions to be overlapped with each other after the stitch loops of the fold-back knitting fabric part are subjected to a bind-off process.

* * * * *